United States Patent [19]

Tahara

[11] Patent Number: 4,510,485

[45] Date of Patent: Apr. 9, 1985

[54] SOUND GENERATING DEVICE FOR JOGGER

[75] Inventor: Iwao Tahara, Tokyo, Japan

[73] Assignee: Casio Computer Co., Ltd., Tokyo, Japan

[21] Appl. No.: 643,089

[22] Filed: Aug. 21, 1984

Related U.S. Application Data

[63] Continuation of Ser. No. 361,473, Mar. 23, 1982, abandoned.

[30] Foreign Application Priority Data

Mar. 31, 1981 [JP] Japan ..... 56-47992
Mar. 31, 1981 [JP] Japan ..... 56-47999
Mar. 31, 1981 [JP] Japan ..... 56-48003

[51] Int. Cl.[3] ..... G08B 23/00

[52] U.S. Cl. ..... 340/323 R; 368/10; 368/108; 377/5; 540/321; 340/384 E

[58] Field of Search ..... 340/309.15, 321, 323, 340/328, 331, 384 E, 384 R; 368/2, 8, 30, 97, 108, 10; 377/5; 272/DIG. 5, DIG. 9

[56] References Cited

U.S. PATENT DOCUMENTS 3,877,216 4/1975 Mounce ..... 368/108
4,062,007 12/1977 Scott ..... 340/309.15
4,218,871 8/1980 Moritani ..... 368/108
4,220,996 9/1980 Searcy ..... 377/5
4,285,041 8/1981 Smith ..... 272/DIG. 5
4,337,529 6/1982 Morokawa ..... 340/323 R

OTHER PUBLICATIONS

5/5/80 Advertisement from Butler Associated Goals.

*Primary Examiner*—James J. Groody
*Assistant Examiner*—Michael F. Heim
*Attorney, Agent, or Firm*—Frishauf, Holt, Goodman and Woodward

[57] ABSTRACT

A sound generating device for a jogger has a generator circuit for generating pace signals the frequencies of which are different from each other in correspondence with different tempos and for generating reference clock pulses, a time counter for receiving and counting the reference clock pulses, and circuits for selectively supplying pace signals the frequencies of which are different from each other and which are supplied from the generator circuit. In response to an instruction signal generated by a switching operation, the time counter starts counting. Simultaneously, based on a selected pace signal from the generator circuit, a desired pace sound can be produced.

5 Claims, 13 Drawing Figures

SOUND GENERATING DEVICE FOR JOGGER

This application is a continuation of application Ser. No. 361,473, filed Mar. 23, 1982, now abandoned.

BACKGROUND OF THE INVENTION

The present invention relates to an improved sound generating device for a jogger to enable jogging at a desired rate.

Jogging as a sport has recently become popular to keep good health. In order to increase the effects of jogging, a pacemaker which can be attached on a wrist and which generates an electronic sound at a constant tempo as a pace sound is commercially available. With the pacemaker of this type, the user arbitrarily adjusts the tempo of the pace sound.

It is convenient for the user if a pacemaker has the capability of displaying the jogging time and distance he has completed in addition to the principal function of sound generation. However, a sound circuit and a time display circuit are separately controlled in the conventional pacemaker. Therefore, when these circuits are to be controlled simultaneously, or when a switch is to be made from simultaneous control to separate control and vice versa, operation is complicated and cumbersome. In particular, the sound generating device is very convenient if it is assembled in a wristwatch. However, since a control system for the wristwatch must be incorporated separately from that for the sound generating device, the number of switches to be included increases and the switching operation becomes complex.

SUMMARY OF THE INVENTION

The present invention has been made to solve the above problems, and has as an object to provide a sound generating device for a jogger which performs the time measuring operation and sound generating operation of a pace sound simultaneously, in response to a start instruction.

In order to achieve the above object of the present invention, there is provided a sound generating device for a jogger, comprising:

switching means ($S_2$, $S_3$, 18) for selectively supplying start and stop instruction signals and select instruction signal in accordance with at least one switching operation;

time counting means (44) for controlling a start and stop of a counting operation of said time counting reference signals in accordance with the start and stop instruction signals from said switching means ($S_2$, $S_3$, 18) and for producing count time data;

means for displaying time data which is output from said time counting means (44);

pace signal generating means (41) for receiving said time counting reference signal and for generating a plurality of pace signals of a different cycle;

pace signal selecting means (42, 47, 48, 49, 50, 51, 55) for selecting a pace signal of a desired cycle from said plurality of pace signals produced from said pace signal generating means, by said select instruction signal, and for producing it as an output signal;

first pace signal supply controlling means (46, 56) connected to said pace signal selecting means for producing the selected pace signal as a desired signal in accordance with said start instruction signal;

sound generating means (17, 20) for receiving said desired pace signal from said first pace signal supply controlling means and for generating a pace sound.

With the above arrangement of the sound generating device for a jogger according to the present invention, the time counting means starts counting simultaneously as the instruction signal is generated by the switching means. In the conventional sound generating device for a jogger, the pace sound generating operation and the time counting operation are separately controlled. However, with the sound generating device for a jogger according to the present invention, the operation can be performed efficiently.

Further, the pace sound corresponding to the pace signal selected on the basis of the instruction signal generated by the operation with the switching means is produced independently of the time counting operation. Therefore, the user can see if pace sound is generated at the intervals he desired, before he starts jogging.

Further, the pace signal coupled to the time counting means and selected in the pace signal selecting means is supplied to the sound generating means at predetermined intervals and continues for a predetermined period of time, that is, a few seconds. Thus, the desired pace sound is intermittently produced. The power consumption in the sound generating section is extremely low.

DETAILED DESCRIPTION OF THE PREFERRED EMBODIMENTS

Figure 1:
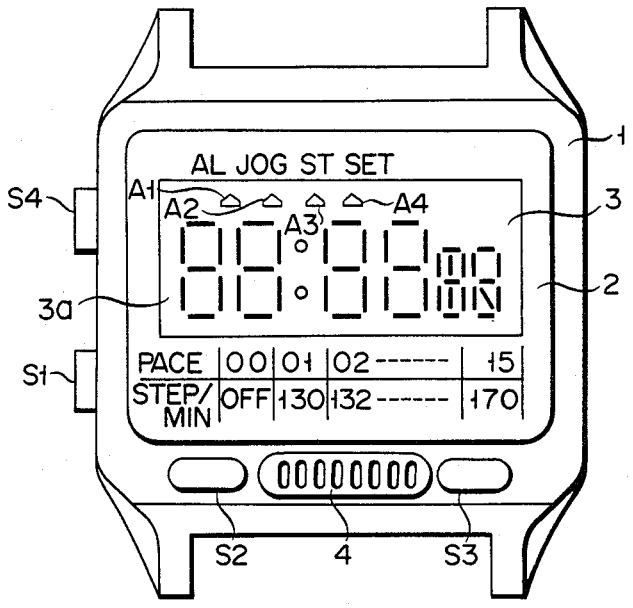
FIG. 1 is a front view showing the outer appearance of an electronic wristwatch incorporating a sound generating device for a jogger according to one embodiment of the present invention.

FIG. 1 is a front view showing the outer appearance of an electronic wristwatch incorporating a sound generating device for a jogger. A face 2 and a display part 3 at part of the face 2 are disposed at the center of a wristwatch case 1. Further, at predetermined positions are arranged holes 4 for a speaker, a first switch S1 for switching modes, a second switch S2 for selecting digits of "hour" and "minute" which are displayed at the display part 3, a third switch S3 for setting data in each mode, and a fourth switch S4 for controlling a sound.

Above the display part 3 of the face 2 are printed symbols "AL" for the alarm mode, "JOG" for the jogging mode, "ST" for the stopwatch mode, and "SET" for time setting mode. Below the display part 3 of the face 2 are printed a symbol "PACE" and pace numbers "00", "01", "02", . . . , "15", and symbols "STEP/MIN" and "OFF" and the step numbers "130", "132", . . . , "170". The display part 3 comprises, for example, liquid crystal display elements. A 6-digit data display portion 3*a* and dot-display elements A1 to A4 respectively corresponding to the mode indicating symbols "AL", "JOG", "ST", and "SET" printed on the face 2, are included in the display part 3.

The arrangement of the electronic circuit inside the wristwatch case 1 will be described with reference to FIG. 2.

Figure 2:
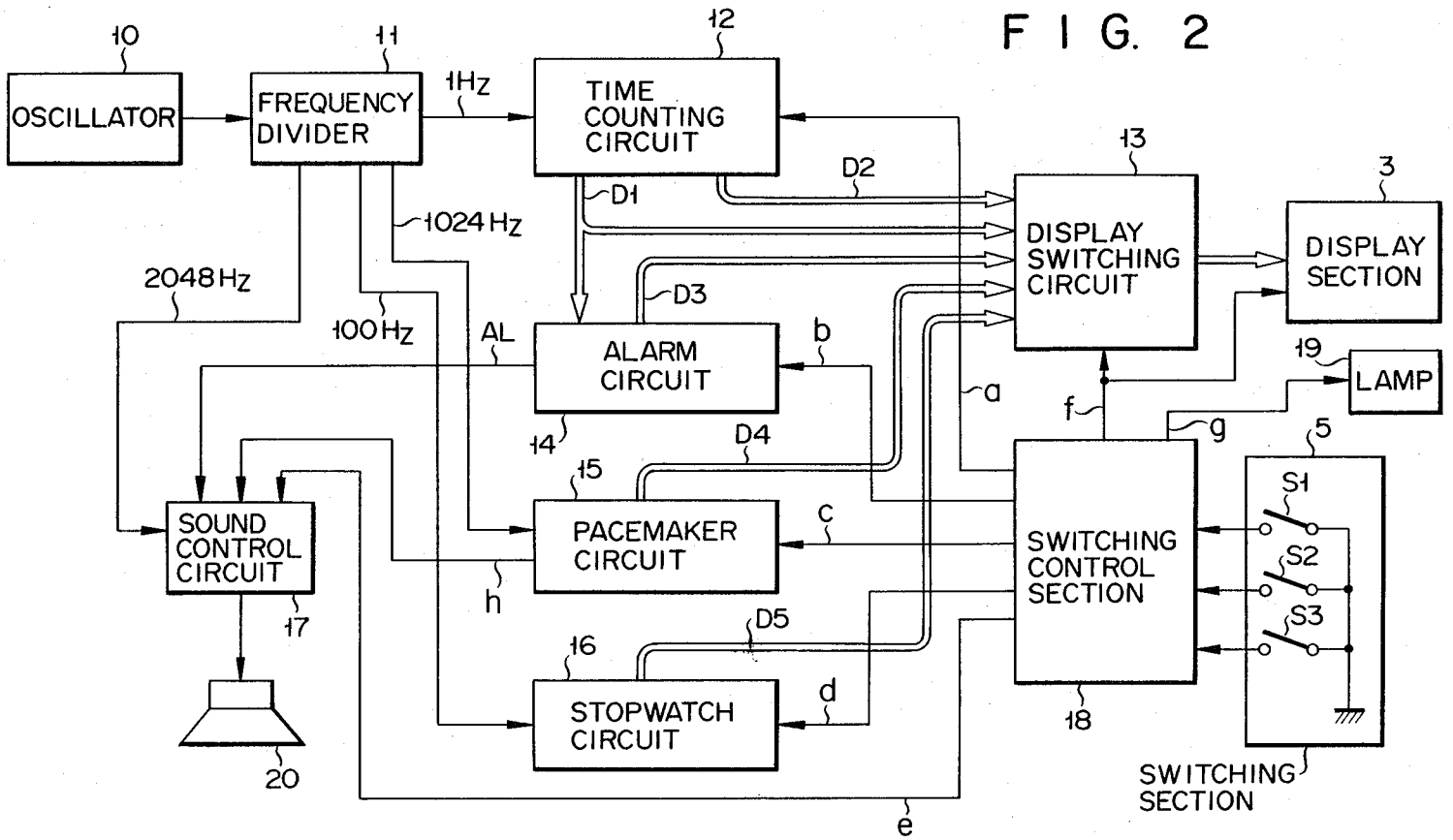
FIG. 2 is a block diagram of the sound generating device for a jogger according to one embodiment of the present invention.

Referring to FIG. 2, an oscillator 10 is provided for generating a time counting reference signal. The reference signal generated from the oscillator 10 is frequency-divided to a signal of 1 Hz through a frequency divider 11 and supplied to a time counting circuit 12. The time counting circuit 12 receives the signal of 1 Hz and performs time counting so as to generate time data D1 ("hour", "minute" and "second" data) and date data D2 (data for "month of the year", "day of the month" and "day of the week"). The time data D1 and the date data D2 are selected in a display switching circuit 13 and displayed at the display section or part 3. Further, the time data D1 output from the time counting circuit 12 is supplied as comparison data to an alarm circuit 14. The frequency divider 11 generates, for example, signals of 2048 Hz, 1024 Hz, 100 Hz besides the signal of 1 Hz as described above. The signal of 1024 Hz is supplied to a pacemaker circuit 15. The signal of 100 Hz is supplied to a stopwatch circuit 16 and the signal of 2048 Hz is supplied to a sound control circuit section 17. With the first to third switches S1 to S3 in a switching section 5, a switching control section 18 produces a time setting signal a, an alarm setting signal b, a pacemaker control signal c, a stopwatch control signal d, a mode switching sound signal e, a display switching control signal f, and an illumination signal g. These signals are respectively supplied to the time counting circuit 12, the alarm circuit 14, the pacemaker circuit 15, the stopwatch circuit 16, the sound control circuit 17, the display switching circuit 13, the display part 3 and a lamp 19. The lamp 19 is used to illuminate the display part 3 at night. With the third switch S3, the lamp 19 is lit. The alarm circuit 14 compares preset time with the time data D1 which indicates the current time. If they coincide, the alarm signal AL is supplied to the sound control section 17. At the selected pace, the pacemaker circuit 15 generates a pace sound signal h to the sound control section 17. The sound control section 17 drives a speaker 20 in response to the alarm signal AL the frequency of which is 2048 Hz. Sound is produced from the speaker in accordance with the predetermined mode of operation. Alarm time D3 read out from the alarm circuit 14, pace data D4 read out from the pacemaker circuit 15, and stopwatch data D5 read out from the stopwatch circuit 16 are selected in the display switching circuit 13 and displayed at the display part 3.

Figure 3:
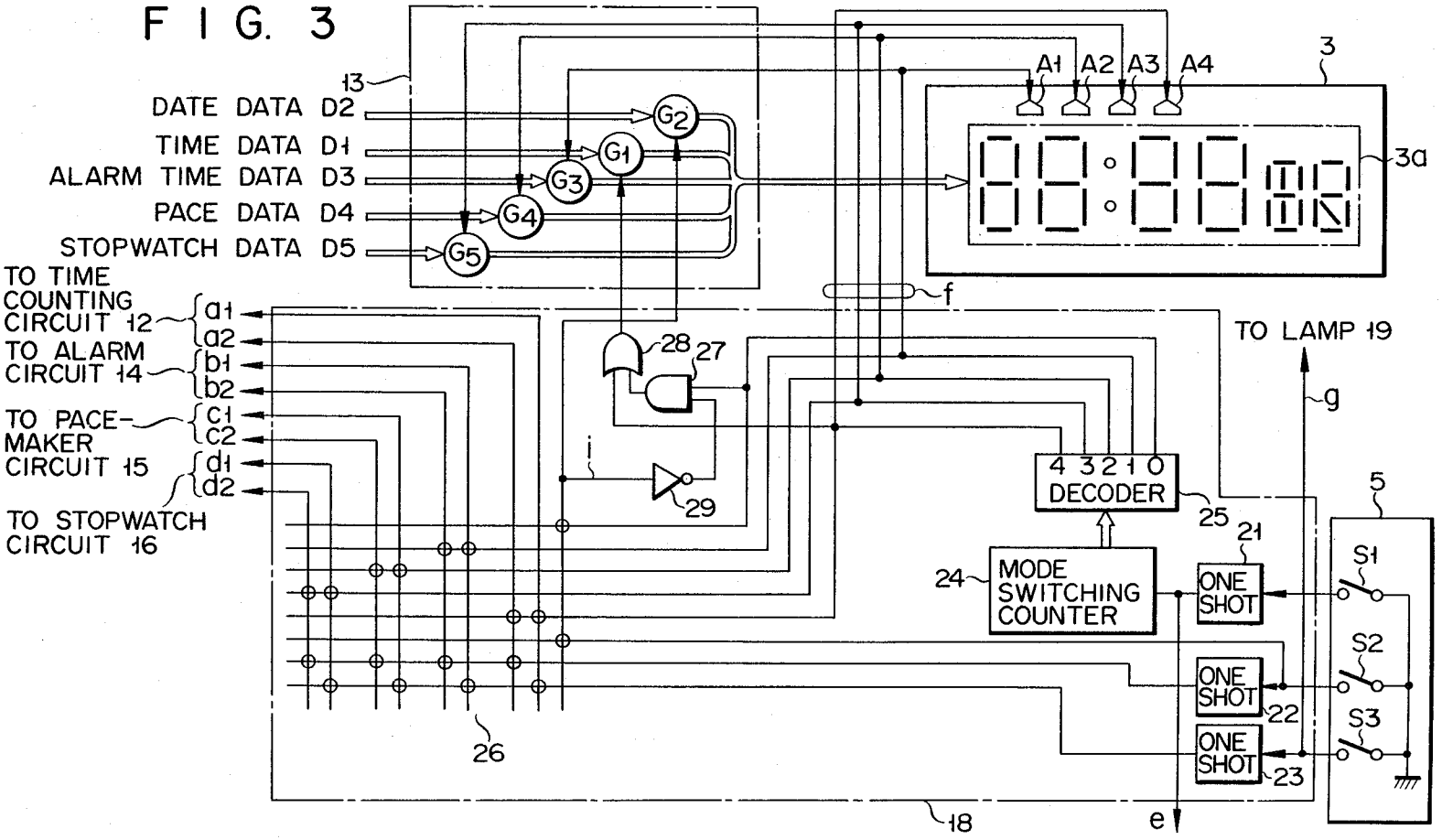
FIG. 3 is a view illustrating the detailed circuit arrangement of the switching control section 18, the display switching circuit 13 and the display part 3 of FIG. 2, and the mutual connections thereof.

The parts of the circuit of FIG. 2 will be described in detail with reference to FIGS. 3 to 5. FIG. 3 is a detailed view showing the display switching circuit 13, the display part 3 and the switch control section 18. Referring to FIG. 3, one-shot circuits 21, 22, and 23 are arranged in the switch control section 18. The one-shot circuits 21 to 23 respectively receive operation signals from the switches S1 to S3. In this case, the operation signal from the third switch S3 is supplied to the one-shot circuit 23 and supplied as the illumination signal g to the lamp 19. The output from the one-shot circuit 21 is supplied to a mode switching counter 24 and supplied as the mode switching sound signal e to the sound control section 17. The mode switching counter 24 is, for example, a 5-scale counter. Count outputs f of "0" to "4" (quinary notation) are decoded in a decoder 25 and supplied to a decoder 26. An output for "0" which is output from the decoder 25 is input to an AND circuit 27. Other outputs for "1" to "4" which are output from the decoder 25 are supplied as drive signals to the dot display elements A1 to A4 of the display part 3. Further, the decoded outputs for "1" to "3" which are output from the decoder 25 are directly supplied to the display switching circuit 13. However, the decoded output for "4" which is output from the decoder 25 is supplied to the display switching circuit 13 through an OR circuit 28. Further, the output from the AND circuit 27 is supplied to the OR circuit 28. The display switching circuit 13 comprises gate circuits G1 to G5 which respectively select data D1 to D5 supplied from the circuits described above. In particular, the gate circuit G1 is controlled by the output from the OR circuit 28. The gate circuit G2 is controlled by an output i from the decoder 26. Further, the gate circuits G3 to G5 are respectively controlled by decoded outputs for "1" to "3". Data selected by the gate circuits G1 to G5 is supplied to the display part 3 and displayed at the data display portion 3*a*. The outputs from the one-shot circuits 22 and 23 and the operation signal from the second switch S2 are supplied to the decoder 26 in the switching control section 18. The decoder 26 produces the time setting signal a (a1, a2) which is supplied to the time counting circuit 12, the alarm setting signal b (b1, b2) which is supplied to the alarm circuit 14, the pacemaker control signal c (c1, c2) which is supplied to the pacemaker circuit 15, the stopwatch control signal d (d1, d2) which is supplied to the stopwatch circuit 16, and the gate signal i which controls the gate circuit G2 of the display switching circuit 13. The decoder 26 selects an output line in response to the output from the decoder 25. Further, with the second and third switches S2 and S3, the decoder 26 outputs one of the signals a to d and i to the selected output line described above. The gate signal i generated from the decoder 26 is supplied to the gate circuit G2, and to the AND circuit 27 through an inverter 29.

Figure 4:
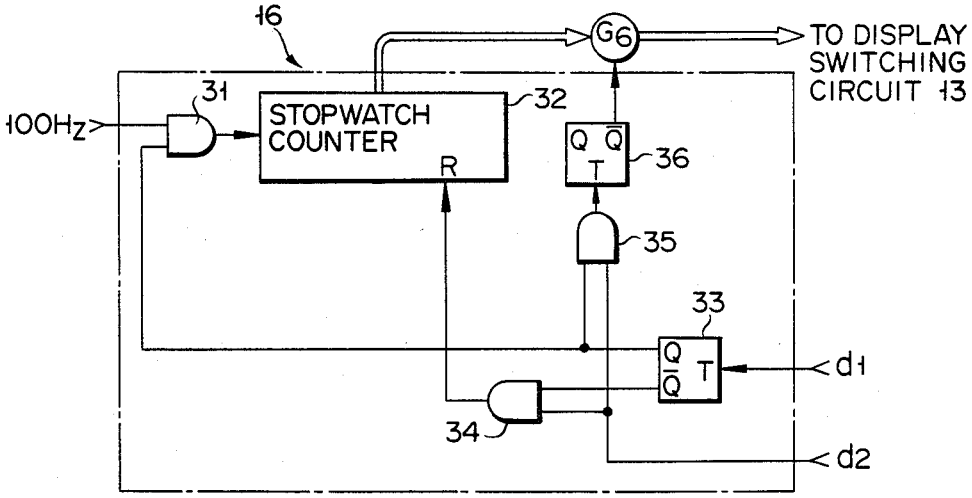
FIG. 4 is a detailed circuit diagram of the stopwatch circuit 16 of FIG. 2.
Figure 5:
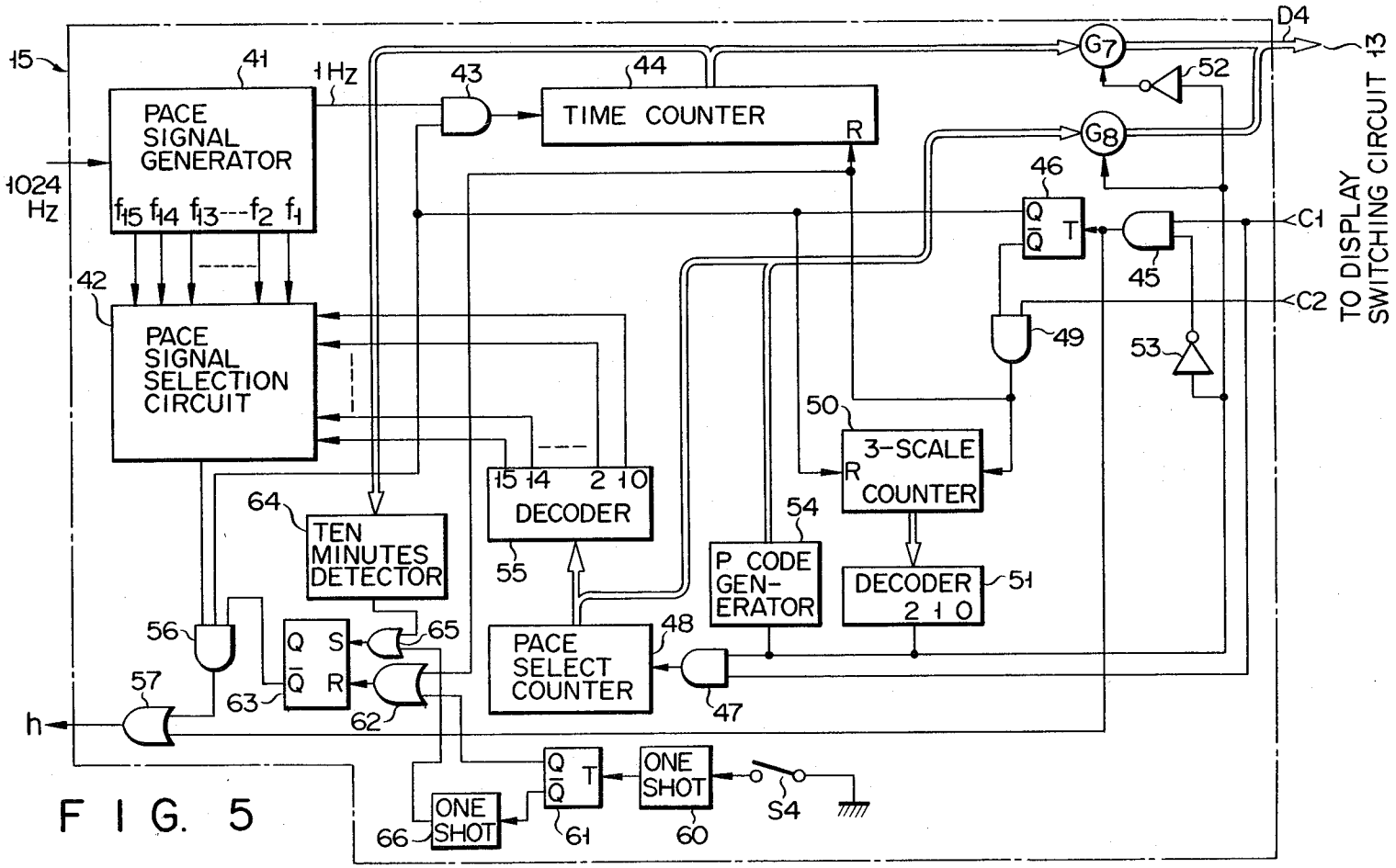
FIG. 5 is a detailed circuit diagram of the pacemaker circuit 15 of FIG. 2.

FIG. 4 shows the stopwatch circuit 16 in detail. The signal of 100 Hz supplied from the frequency divider 11 is supplied as a count-up signal to a stopwatch counter 32 through an AND circuit 31. The count value of the stopwatch counter 32 is supplied as the time counting signal to the display switching circuit 13 through a gate circuit G6. The AND circuit 31 is controlled by an output from an output terminal Q of a T flip-flop 33. The T flip-flop 33 performs inversion every time the signal d1 from the switching control section 18 is supplied to a triggering terminal T thereof. The output signal from the output terminal $\overline{Q}$ is supplied together with the signal d2 from the switching control section 18 to a reset terminal R of the stopwatch counter 32 through an AND circuit 34. The output from the output terminal Q of the T flip-flop 33 is also supplied to a triggering terminal T of a T flip-flop 36 through an AND circuit 35. The output from the output terminal $\overline{Q}$ of the T flip-flop 36 is supplied as the gate signal to the gate circuit G6.

The pacemaker circuit 15 will be described in detail with reference to FIG. 5. Referring to the figure, reference numeral 41 denotes a clock pulse or pace signal generator. In response to the signal of 1024 Hz which is supplied from the frequency divider 11 in FIG. 2, the clock pulse generator 41 generates clock pulses f1 to f15 as shown in Table 1 and supplies them to a pace signal selection circuit 42. The pace signal selection circuit 42 has a plurality of AND gates. In response to a clock pulse, among the clock pulses f1 to f15, corresponding to an output from a decoder 55 to be described later, a corresponding AND gate is rendered conductive so as to output a predetermined pace signal.

TABLE 1

| Frequency | Pulse Interval | Pace (Step/min) | Display |
|---|---|---|---|
| | OFF | OFF | P0 |
| f1 | 460.8 ms | 130 | P1 |
| f2 | 453.2 ms | 133 | P2 |
| f3 | 445.4 ms | 135 | P3 |
| f4 | 437.6 ms | 137 | P4 |
| f5 | 429.8 ms | 140 | P5 |
| f6 | 421.9 ms | 142 | P6 |
| f7 | 414.1 ms | 145 | P7 |
| f8 | 406.2 ms | 148 | P8 |
| f9 | 398.4 ms | 151 | P9 |
| f10 | 390.6 ms | 154 | P10 |
| f11 | 382.9 ms | 157 | P11 |
| f12 | 375.0 ms | 160 | P12 |
| f13 | 367.2 ms | 163 | P13 |
| f14 | 359.3 ms | 167 | P14 |
| f15 | 351.5 ms | 171 | P15 |

Further, the clock pulse generator 41 frequency-divides the signal of 1024 Hz and produces the signal of 1 Hz which is supplied to a time counter 44 through an AND circuit 43. The time counter 44 counts the signal of 1 Hz and the count value is output to the display switching circuit 13 through a gate circuit G7. The signal c1 supplied from the decoder 26 of the switching control section 18 of FIG. 3 is supplied to a triggering terminal T of a T flip-flop 46 through an AND circuit 45 and simultaneously to a 16-scale pace selection counter 48 through an AND circuit 47. The signal c2 supplied from the decoder 26 of the switching control section 18 is supplied to a reset terminal R of the time counter 44 and to a count signal input terminal of a 3-scale counter 50 through an AND circuit 49 controlled by the output from the output terminal $\overline{Q}$ of the T-flip-flop 46. The output from the output terminal Q of the T flip-flop 46 is supplied to the AND circuit 43 and the reset terminal R of the 3-scale counter 50. The count value of the 3-scale counter 50 is decoded in a decoder 51. The decoded output for "2" is supplied to the gate circuit G7 through an inverter 52 and simultaneously to the AND circuit 45 through an inverter 53. The decoded output for "2" which is output from the decoder 51 is also supplied to a P code generator 54 and simultaneously supplied as the gate control signal to the pace selection counter 48 with the signal c1 from the decoder 26 through the AND circuit 47. The count value of the pace selection counter 48 and a P code which is generated from the P code generator 54 are supplied to the display switching circuit 13 through a gate circuit G8. The gate circuit G8 is controlled in response to the decoded output for "2" from the decoder 51. The count value of the pace selection counter 48 is decoded in the decoder 55 and supplied as the pace selection signal to the pace signal selection circuit 42. The pace signal selected in the pace signal selection circuit 42 is then supplied to an OR circuit 57 through an AND circuit 56. The signal from the AND circuit 45 is supplied to the OR circuit 57. The output from the OR circuit 57 is supplied as the pace sound signal h to the sound control section 17. Further, the operation signal from the fourth switch S4 for controlling the sound is output as a one-shot pulse through a one-shot circuit 60 and supplied to a triggering terminal T of a T flip-flop 61. The output from the output terminal Q of the T flip-flop 61 together with the output from the AND circuit 49 are supplied to a reset terminal R of a flip-flop 63 through an OR circuit 62. A detection signal from a ten minutes detector 64 for detecting a count value of the time counter 44 corresponding to 10 minutes is input to a set terminal S of the flip-flop 63 through an OR circuit 65. Further, the output from the output terminal $\overline{Q}$ of the T flip-flop 61 is supplied to the set terminal S of the flip-flop 63 through a one-shot circuit 66 and the OR circuit 65. The output from the output terminal $\overline{Q}$ of the flip-flop 63 and the output from the output terminal Q of the T flip-flop 46 are supplied as the gate signals to the AND circuit 56.

Figure 6:
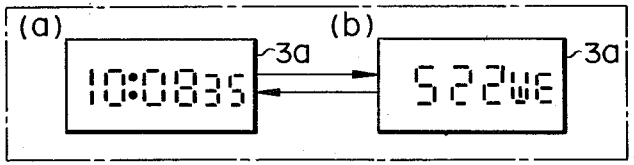
FIGS. 6 to 10 are views for explaining the display states at the display section in different modes, respectively.

The mode of operation of the sound generating device for a jogger according to the embodiment described above will be described. As shown in FIG. 2, data D1 to D5 which are respectively supplied from the circuits 12, 14, 15 and 16 are supplied to the display switching circuit 13. One of these data D1 to D5 is selected in response to the signal f from the switch control section 18 and supplied to the display part 3 in which this data is displayed. The display switching operation is performed by the first switch S1 for switching the modes. When the first switch S1 is depressed, the operation signal thereof is supplied to the switching control section 18, as shown in FIG. 3, so as to generate the one-shot pulse through the one-shot circuit 21. This one-shot pulse is supplied as the mode switching sound signal e to the sound control section 17. Sound which indicates mode switching is produced at a frequency of 2048 Hz at the speaker 20. The one-shot pulse output from the one-shot circuit 21 is supplied to the mode switching counter 24 and counted up therein. Assume that the user depresses the first switch S1 so as to reset the count value of the mode switching counter 24 to "0". The decoded output for "0" from the decoder 25 becomes "1" which is, in turn, supplied to the decoder 26 and the AND circuit 27. The decoder 26 selects the output line of the signal i in response to the output from the decoder 25. At this time, the second switch S2 is not depressed, so that the signal i is of level "0". Therefore, the output from the inverter 29 becomes "1" so as to turn on the AND circuit 27. The decoded output for "0" of the decoder 25 is supplied to the display switching circuit 13 through the AND circuit 27 and the OR circuit 28 so as to turn on the gate circuit G1. The time data D1 output from the time counting circuit 12 is supplied to the display part 3 through the gate circuit G1 and displayed at the digital display portion 3*a* so as to indicate the current time, as shown in FIG. 6(*a*). When today's date is to be displayed, the second switch S2 is depressed. When the second switch S2 is depressed, the operation signal thereof is supplied to the decoder 26. The output signal i from the decoder 26 becomes "1". Therefore, the output from the inverter 29 becomes "0". The AND circuit 27 and the gate circuit G1 are not thus rendered conductive. The output signal i from the decoder 26 is supplied to the display switching circuit 13 so as to turn on the gate circuit G2. The date data D2 output from the time counting circuit 12 is supplied to the display part 3 through the gate circuit G2. As shown in FIG. 6(*b*), the date display is performed. This date display is performed while the second switch S2 is being depressed. However, when the second switch S2 is released, the current time display mode is restored.

Figure 7:
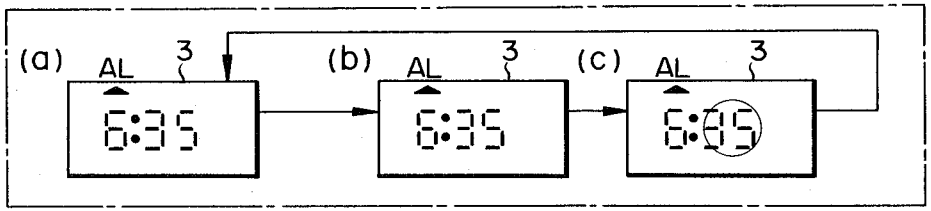

In the above time display mode, when the first switch S1 for switching the modes is depressed, the alarm mode is initiated. Upon depression of the first switch S1, the mode switching sound is produced and the count value of the mode switching counter 24 is incremented from "0" to "1". Therefore, the decoded output for "1" from the decoder 25 becomes "1" and the dot display element A1 of the display part 3 is driven so as to indicate the initiation of the alarm mode "AL". At the same time, the gate circuit G3 of the display switching circuit 13 is turned on. Alarm time data D3 output from the alarm circuit 14 is selected in the display switching circuit 13 and displayed at the display part 3, as shown in FIG. 7(*a*). When the alarm time is to be set in the alarm circuit 14, or when the preset time is to be changed, in the alarm mode, digit selection of the display time is performed with the second switch S2 and time data is set with the third switch S3. In other words, in the alarm mode, the decoded output for "1" from the decoder 25 is supplied to the decoder 26 and the output lines corresponding to the signals b1 and b2 are selected. In this condition, when the second switch S2 is depressed, the one-shot pulse is output from the one-shot circuit 22 and this pulse is output as the signal b2 from the decoder 26. The signal b2 is supplied to the alarm circuit 14 and used to designate the digit for the unit of "minute" as shown in FIG. 7(*b*). In this condition, when the third switch S3 is depressed, the one-shot pulse is output from the one-shot circuit 23 and decoded in the decoder 26. This decoded signal is output from the decoder 26 as the signal b1. This signal b1 is supplied to the alarm circuit 14 and used to increment the count value for the unit of "hour". The preset contents of the alarm circuit 14 are displayed at the display part 3. Therefore, watching the display contents, the user can depress the third switch S3 so as to obtain the desired time. Thus, the desired time data is preset. After data for the unit of "hour" is set, the second switch S2 is depressed again. Therefore, the signal b2 is output from the decoder 26 and is supplied to the alarm circuit 14. In the alarm circuit 14, the digit of "minute" is specified, as shown in FIG. 7(*c*). In this condition, when the third switch S3 is depressed, the signal b1 is output from the decoder 26 and supplied to the alarm circuit 14. In the alarm circuit 14, data for the unit of "minute" is preset. Thereafter, the second switch S2 is depressed to restore the initial condition, as shown in FIG. 7(*a*).

Figure 8:
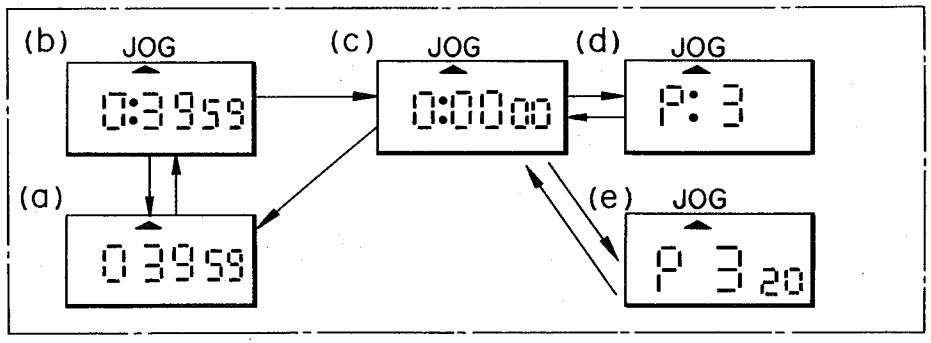

Further, in the alarm mode, when the first switch S1 is depressed, the jogging mode is initiated and the function of the pacemaker is specified. When the first switch S1 is further depressed, the count value of the mode switching counter 24 is incremented from "1" to "2". The decoded output for "2" from the decoder 25 becomes level "1". Therefore, the dot display element A2 of the display part 3 is driven and the symbol "JOG" which indicates the jogging mode is displayed thereat. In response to the output from the decoder 25 as described above, the gate circuit G4 of the display switching circuit 13 is turned on. The pace data D4 output from the pacemaker circuit 15 is selected and supplied to the display part 3. Further, the decoded output for "2" from the decoder 25 is supplied to the decoder 26. The decoder 26 selects the output lines corresponding to the signals c1 and c2. In the jogging mode, the generation of the pacemaker sound and the counting of the jogging time are simultaneously performed. The third switch S3 serves to function as the start and stop switches. In the jogging mode, when the third switch S3 is depressed, the one-shot pulse is output from a one-shot circuit 23. This pulse is decoded in the decoder 26 and output as the signal c1. This signal c1 is supplied to the pacemaker circuit 15 of FIG. 5 and the AND circuit 45. At this time, the decoded output for "2" from the decoder 51 is a "0" and the output from the inverter 53 becomes "1". This output is supplied to the AND circuit 45. Therefore, the signal c1 is supplied to the T flip-flop 46 through the AND circuit 45 and simultaneously supplied as the signal h to the sound control section 17 through the OR circuit 57. The sound control section 17 is operated so as to produce a sound which indicates the initial operation of the pacemaker circuit 15 at the speaker 20. Further, the inversion operation of the T flip-flop 46 is performed in response to the output from the AND circuit 45. A signal of level "1" is output from the output terminal Q of the T flip-flop 46. This output is supplied to the reset terminal R of the 3-scale counter 50 and the AND circuits 43 and 56. The AND circuit 43 is thus rendered conductive and the signal of 1 Hz is output from the clock pulse generator 41. This signal is supplied to the time counter 44. In this condition, the decoded output for "2" from the decoder 51 is level "0" and the output from the inverter 52 is "1". The gate circuit G7 is thus rendered conductive. Time counting data output from the time counter 44 is supplied to the display switching circuit 13 through the gate circuit G7. As shown in FIG. 8(*a*), this data is displayed at the display part 3. Further, the count value of the pace selection counter 48 is set by the second and third switches S2 and S3. In accordance with the preset contents, the signal is supplied from the decoder 55 to the pace signal selection circuit 42. The pace signal selection circuit 42 selects one of the clock pulses f1 to f15 output from the clock pulse generator 41, as shown in Table 1, in response to the signal from the decoder 55. The selected pulse is supplied to the AND circuit 56. At this time, the flip-flop 63 is in the reset status and generates the output of level "1" from the output terminal $\overline{Q}$. This output is supplied to the AND circuit 56. Therefore, the AND circuit 56 is rendered conductive when the signal of level "1" is supplied from the T flip-flop 46. The pace signal selected by the pace signal selection circuit 42 is output from the AND circuit 56. This pace signal is supplied to the sound control section 17 through the OR circuit 57 and the pace sound is produced thereat. The time counter 44 thus starts counting. When the count value reaches a value corresponding to 10 minutes, the 10 minutes detector 64 which, for example, comprises a decoder, generates the detection signal. The flip-flop 63 is thus set. The output from the output terminal $\overline{Q}$ of the flip-flop 63 is set to "0" and the AND circuit 56 is turned off. The pace signal is not transferred from the pace signal selection circuit 42 to the sound control section 17 and the pace sound is no longer produced. In this manner, generation of the pace sound is automatically interrupted after a certain period of time, for example, 10 minutes in this embodiment, when the user gets used to the pace determined with the pace sound. When the pace sound is to be produced again after it is interrupted, the fourth switch S4 for controlling the pace sound is depressed. When the fourth switch S4 is depressed, a one-shot pulse is output from the one-shot circuit 60. The inversion operation of the T flip-flop 61 is performed and the output from the output terminal Q is set to "1". This output serves to reset the flop-flop 63 through the OR circuit 62. The output from the output terminal $\overline{Q}$ of the flip-flop 63 is set to "1" and the AND circuit 56 is rendered conductive. The pace signal output from the pace signal selection circuit 42 is supplied to the sound control section 17 again, and the pace sound is produced again. However, when the pace sound is to be interrupted again, the fourth switch S4 is depressed again. When the fourth switch S4 is depressed again, the inversion operation of the T flip-flop 61 is performed. The output from the output terminal $\overline{Q}$ is supplied to the one-shot circuit 66 so as to produce the one-shot pulse therefrom. Thus, the flip-flop 63 is set. The output from the output terminal $\overline{Q}$ of the flip-flop 63 is set to "0" and the AND circuit 56 is turned off. As a result, the operation for generating the pace sound is interrupted. If the jogger desires to interrupt jogging or terminate it, the third switch S3 is depressed again. Upon depression of the third switch S3, the signal c1 is output from the switch control section 18 and supplied to the T flip-flop 46 through the AND circuit 45. The inversion operation of the T flip-flop 46 is performed. The output from the output terminal Q of the T flip-flop 46 is set to "0" and the AND circuits 43 and 56 are turned off. In response to this operation, the time counter 44 stops counting. The count value at this time is displayed at the display part 3, as shown in FIG. 8(*b*). However, if jogging is to be started again, the third switch S3 is depressed. Upon depression of the third switch S3, the signal c1 is output from the switch control section 18 and supplied to the T flip-flop 46 through the AND circuit 45. The operation of the T flip-flop 46 is inverted and the output from the output terminal Q is set to "1". The AND circuit 43 is thus rendered conductive. Therefore, the time counter 44 starts counting again. However, as shown in FIG. 8(*b*), when the jogger desires to stop jogging while the counting operation of the time counter 44 is being interrupted, the second switch S2 is depressed. Upon depression of the second switch S2, the signal c2 is output from the switch control section 18 and supplied to the AND circuit 49. At this time, the output from the output terminal $\overline{Q}$ of the T flip-flop 46 is set to "1" and supplied to the AND circuit 49. The signal c2 is output through the AND circuit 49 so as to increment the count value of the 3-scale of counter 50 from "0" to "1". At the same time, as shown in FIG. 8(*c*), the count value of the time counter 44 is cleared. When the counting operation is to be started, in the above condition, the third switch S3 is depressed. The inversion operation of the flip-flop 46 is performed and the counting operation is performed by the time counter 44. On the other hand, when the jogging pace is to be set, the time counter 44 is cleared as shown in FIG. 8(*c*) and the second switch S2 is depressed. Upon depression of the second switch S2, the signal c2 is output from the switch control section 18 and supplied to the 3-scale counter 50 through the AND circuit 49. The count value of 3-scale of counter 50 is incremented from "1" to "2". The decoded output for "2" from the decoder 51 is set to level "1". The outputs from the inverters 52 and 53 are set to "0". The gate circuit G7 and the AND circuit 45 are then turned off. The output from the decoder 51 is also supplied to the AND circuit 47 and the P code generator 54. The P code generator 54 generates the P code. This P code and the count value of the pace selection counter 48 are supplied to the display switching circuit 13 through the gate circuit G8. They are displayed as "P:3" at the display part 3, as shown in FIG. 8(*d*). Subsequently, when the third switch S3 is depressed, the signal cl is output from the switch control section 18 and supplied to the pace selection counter 48 through the AND circuit 47. The count value of the pace selection counter 48 is incremented. This count value of the pace selection counter 48 is displayed at the display part 3. Therefore, the third switch S3 can be depressed the predetermined number of times so as to obtain the desired display contents. The relationship between the paces and the pace signals P0 to P15 is shown in Table 1. Further, as described above, this relationship is displayed on the face 2, resulting in convenience. Upon depression of the second switch S2 after the pace setting, the signal c2 is output from the switch control section 18 and the count value of the 3-scale counter 50 is decremented from "2" to "0". The decoded output for "2" from the decoder 51 is set to level "0". In other words, the state shown in FIG. 8(*b*) is restored. Thereafter, the pace signal is selected in accordance with the count value of the pace selection counter 48. In this manner, in the jogging mode, the pace sound is generated from the beginning for a certain period of time and jogging time is simultaneously counted.

Figure 9:
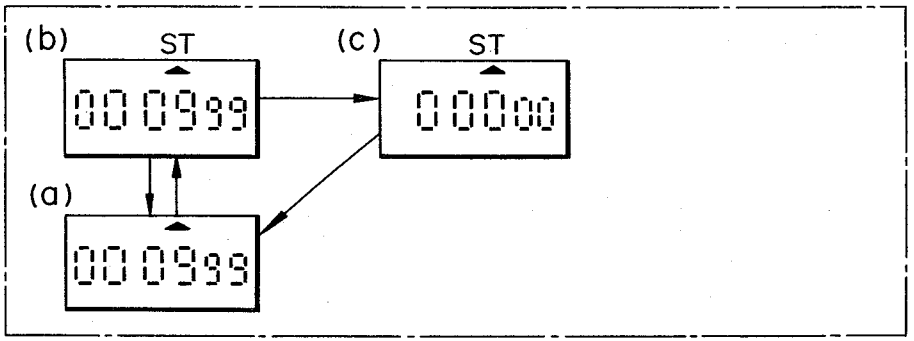

In the jogging mode, when the first switch S1 is depressed, the stopwatch mode is initiated. In particular, upon depression of the first switch S1, the count value of the mode switching counter 24 of the switching control section 18 is incremented from "2" to "3". The decoded output for "3" from the decoder 25 is set to level "1". The dot display element A3 of the display part 3 is driven and the symbol "ST" of the stopwatch mode is displayed thereat. In response to the output from the decoder 25, the gate circuit G5 of the display switching circuit 13 is rendered conductive. The stopwatch data D5 output from the stopwatch circuit 16 is selected and supplied to the display part 3. The decoded output for "3" from the decoder 25 is supplied to the decoder 26. The decoder 26 selects the output lines corresponding to the signals d1 and d2 which are received in the decoder 26. In the stopwatch mode, the third switch S3 serves as the start and stop switches in the same manner as in the jogging mode. When the third switch S3 is depressed at the first time, the one-shot pulse is output from the one-shot circuit 23 and decoded in the decoder 26. The decoder 26 then outputs the signal d1 which is supplied to the stopwatch circuit 16 of FIG. 4. When the stopwatch circuit 16 receives the signal d1, the T flip-flop 33 is inverted and the output from the output terminal Q thereof is set to "1". In response to this signal, the AND circuit 31 is rendered conductive. Therefore, the signal of 100 Hz supplied from the frequency divider 11 is supplied to the stopwatch counter 32 through the AND circuit 31 for starting of counting. Moreover, the output from the output terminal $\overline{Q}$ of the T flip-flop 36 is normally set to "1" and the gate circuit G6 is rendered conductive. The count value of the stopwatch counter 32 is supplied to the display switching circuit 13 through the gate circuit G6. This value is displayed at the display part 3, as shown in FIG. 9(*a*). During the time counting operation, that is, when lap time is to be checked, the second switch S2 is depressed. Upon depression of the second switch S2, the signal d2 is output from the switching control section 18 and supplied to the triggering terminal T of the T flip-flop 36 through the AND circuit 35. The T flip-flop 36 is inverted and the output from the output terminal $\overline{Q}$ thereof is set to "0". The gate G6 is then turned off. Data transfer from the stopwatch counter 32 to the display switching circuit 13 is prohibited. Data is not updated in a buffer (not shown) of the display part 3 and data remains unchanged and displayed. Meanwhile, the stopwatch counter 32 continues the time counting operation. When the second switch S2 is then depressed, the signal d2 is output from the switching control section 18. The T flip-flop 36 is inverted and the output from the output terminal $\overline{Q}$ is set to "1". The gate circuit 36 is then rendered conductive. Therefore, the data transfer from the stopwatch counter 32 to the display switching circuit 13 is started. The current time data is displayed at the display part 3. However, when the time counting operation is to be interrupted, the third switch S3 is depressed. Upon depression of the third switch S3, the signal d1 is output from the switching control section 18 and the T flip-flop 33 is inverted. The output from the output terminal Q of the T flip-flop 33 is set to "0". The AND circuit 31 is turned off and the signal is not supplied to the stopwatch counter 32. In this manner, the time counting operation is interrupted. The current time data is thus displayed at the display part 3, as shown in FIG. 9(*b*). In this condition, when the time counting operation is to be restarted, the third switch S3 is depressed. Further, when the count value of time data is to be cleared, the second switch S2 is depressed. In the status shown in FIG. 9(*b*), the output from the output terminal $\overline{Q}$ of the flip-flop 33 is set to "1". This signal is supplied to the AND circuit 34. Therefore, upon depression of the second switch S2, the signal d2 is output from the switching control section 18. The output from the AND circuit 34 is set to "1". The count value, that is, time counting data of the stopwatch counter 32 is cleared, as shown in FIG. 9(*c*). In this condition, when the third switch S3 is depressed, the T flip-flop 33 is inverted in response to the signal d1. Therefore, the time counting operation is initiated.

Figure 10:
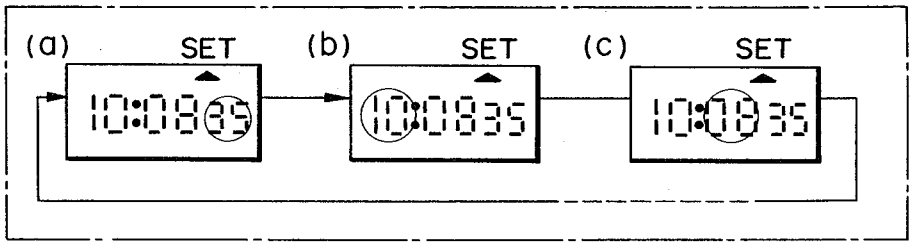

Further, in the stopwatch mode, when the first switch S1 is depressed, the time correction mode is initiated. In particular, upon depression of the first switch S1, the count value of the mode switching counter 24 is incremented from "3" to "4". The decoded output for "4" from the decoder 25 is set to "1". The dot display element A4 of the display part 3 is driven and the symbol "SET" indicating the set mode is displayed thereat. The output from the decoder 25 is supplied to the display switching circuit 13 through the OR circuit 28. The gate G1 is then rendered conductive. Time data D1 output from the time counting circuit 12 is supplied to the display part 3 through the gate circuit G1. Further, the decoded output for "4" from the decoder 25 is supplied to the decoder 26. The decoder 26 selects the output lines corresponding to the signals a1 and a2. Therefore, when the time set mode is initiated, data for "second" is first set, as shown in FIG. 10(*a*). Upon depression of the third switch S3, the one-shot pulse is output from the one-shot circuit 23 and decoded to the signal a1 in the decoder 26. The signal a1 is supplied to the time counting circuit 12 and data of "second" is cleared. When the second switch S2 is depressed, the signal a2 is output from the switching control section 18. Data of "hour" for the time counting circuit 12 is specified, as shown in FIG. 10(*b*). In this condition, when the third switch S3 is depressed, the signal a1 is output from the switching control section 18. Data of "hour" is counted. Upon depression of the third switch S3, data "hour" is matched with the current time. Thereafter, the second switch S2 is depressed. Upon depression of the second switch S2, the signal a2 is output from the switching control section 18. Therefore, data of "minute" of the time counting circuit 12 is set, as shown in FIG. 10(*c*). In this condition, when the third switch S3 is depressed, the signal a1 is output from the switching control section 18. Data of "minute" is incremented. Upon depression of the third switch S3, the data of "minute" is matched with the current time. Thereafter, the status as shown in FIG. 10(*a*) is restored upon depression of the second switch S2.

After desired time is set, the first switch S1 is depressed. The count value of the mode switching counter 24 of the switching control section 18 is decremented from "4" to "0". The decoded output for "0" from the decoder 25 is set to level "1". Then, the normal condition for display time is restored.

In the above embodiment, the jogging paces include 15 steps beginning from 130 steps/min to 170 steps/min. The range of the jogging paces may vary.

Figure 11:
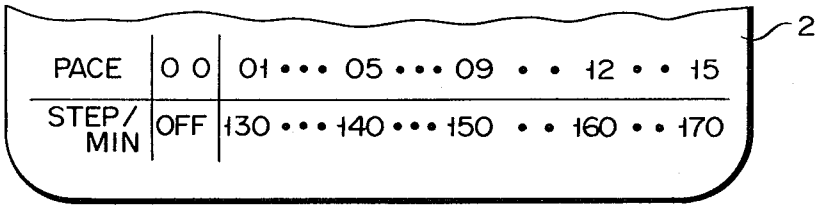
FIG. 11 is a view for explaining an example of pace display different from the pace display of FIG. 8(*d*)

Further, in the above embodiment, the jogging paces per minute are printed on the face 2. However, these paces may be printed on a case or a band. Further, if the printing area is narrow, as shown in FIG. 11, paces 130, 140, . . . may be roughly printed in numbers.

Further, in the above embodiment, the pace number, for example, "P:3" is displayed. However, the pace may be displayed in the unit of steps per min. in number, for example, "130".

Further, in the above embodiment, the sound generating device according to the present invention is applied to a wristwatch. However, the device may be independently arranged. Further, it may be mounted in a stopwatch, a compact electronic calculator, a pendant and so on.

Moreover, in the above embodiment, the period of time in which the pace sound is generated is fixed. However, the period of time may be arbitrarily determined by the user.

A sound generating device according to another embodiment of the present invention will be described with reference to a pacemaker circuit 15 shown in FIG. 12. The same reference numerals as in FIG. 5 denote the same parts in FIG. 12 and the detailed description thereof will be omitted.

Figure 12:
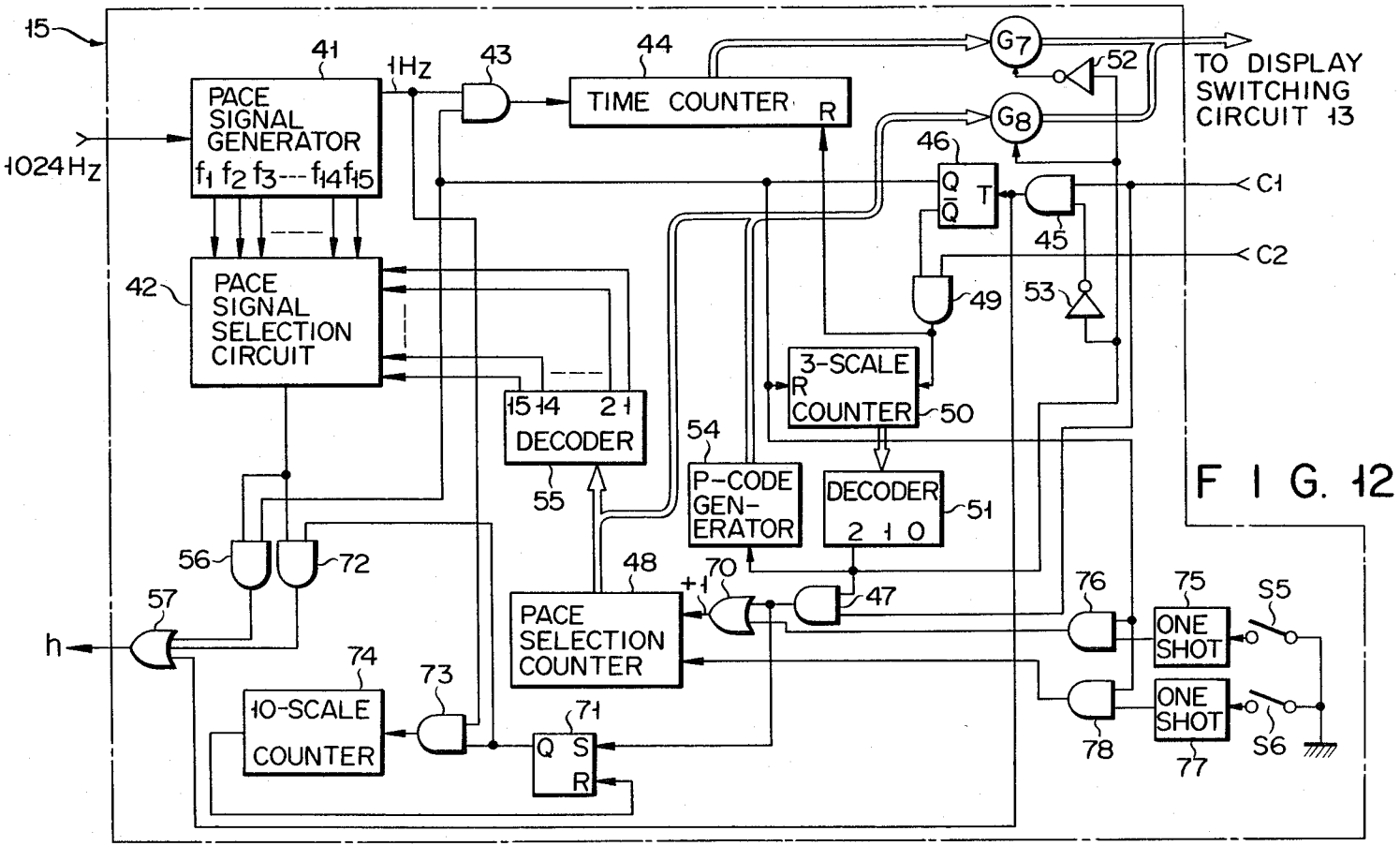
FIG. 12 is a block diagram of a pacemaker circuit 15 according to another embodiment of the present invention.

In the second embodiment of FIG. 12, a predetermined pace sound is produced before jogging and the pace can be checked while the time counting operation of the time counter is being interrupted. Therefore, the desired pace sound can be selected properly.

The AND circuit 47 which receives the decoded output for "2" from the decoder 51 and the signal c1 from the decoder 26 are supplied as the count-up signals to the pace selection circuit 48 through an OR circuit 70. Simultaneously, the output from the AND circuit 47 is supplied to a set terminal of an RS flip-flop 71.

The output from the output terminal Q of the RS flip-flop 71 is output through the OR circuit 57 and an AND circuit 72 the gate of which receives the output from the pace signal selection circuit 42. The pace sound signal h is supplied to the sound control section 17. At the same time, the output from the output terminal Q of the RS flip-flop 71 together with the signal of 1 Hz from the clock pulse generator 41 are supplied to a 10-scale counter 74 (decimal counter) through an AND circuit 73. The 10-scale counter 74 outputs a signal every time the count value thereof reaches 10. This output signal is supplied to the reset terminal of the RS flip-flop 71.

The incrementing operation of the pace selection counter 48 is performed with a fifth switch S5. Upon depression of the fifth switch S5, a signal output from a one-shot circuit 75 is supplied to the pace selection counter 48 through an AND circuit 76 and the OR circuit 70 so as to increment the count value of the pace selection counter 48. The pace selection counter 48 starts down counting when a sixth switch S6 is closed, thus supplying a signal output from a one-shot circuit 77 to the pace selection counter 48 through an AND circuit 78. One of gates of each of the AND circuits 76 and 78 of the pacemaker circuit 15 receives the signal c1 which is generated by the decoder 26 upon depression of the third switch S3 of the switching section 5 and the output from the output terminal Q of the T flip-flop 46, through the AND circuit 45.

As described above, in the pacemaker circuit 15 in the second embodiment, when the pace sound is to be produced in order to set a desired jogging pace before jogging, as shown in FIG. 8(*c*), the second switch S2 is depressed while the time counter 44 is being cleared. Upon depression of the second switch S2, the signal c2 is output from the switching control section 18 and supplied to the 3-scale counter 50 through the AND circuit 49. The count value the 3-scale of counter 50 is incremented from "1" to "2". The decoded output for "2" from the decoder 51 is set to level "1". This output is supplied to one of the inputs of the AND circuit 47. Subsequently, when the third switch S3 is depressed, the signal c1 is output from the switching control section 18 and supplied to the pace selection counter 48 through the AND circuit 47 and the OR circuit 70. The count value of the pace selection counter 48 is incremented. The count value of the pace selection counter 48 is displayed at the display part 3 as described above. Therefore, the display contents can be checked continuously by depressing the third switch S3 so as to set the pace. The relationship between the paces and the pace symbols P0 to P15 is shown in Table 1. Further, they are printed on the face 2 as described above, resulting in convenience for checking. In response to the output from the AND circuit 47, the RS flip-flop 71 is set and the output from the output terminal Q thereof is set to "1". The AND circuits 72 and 73 are thus rendered conductive. When the AND circuit 72 is turned on, the pace signal output from the pace signal section circuit 42 is supplied to the sound control section 17 through the AND circuit 72 and the OR circuit 57. The pace sound corresponding to "P:3" as shown in FIG. 8(*d*) is produced. Also, when the AND circuit 73 is turned on, the signal of 1 Hz generated from the clock pulse generator 41 is supplied to the 10-scale counter 74 through the AND circuit 73. The 10-scale counter 74 starts counting. When the count value of the 10-scale counter 74 reaches 10, a carrier signal is output therefrom. The RS flip-flop 71 is thus reset and the output from the RS flip-flop 71 is set to "0". The AND circuit 72 is turned off and the operation for generating the pace sound is interrupted. At the same time, the AND circuit 73 is turned off and the 10-scale counter 74 stops counting. Thus, upon depression of the third switch S3, when the count value of the pace selection counter 48 is set, the pace sound corresponding to the count value is produced for a certain period of time, for example, 10 seconds in this case. The actual pace sound is thus checked.

When the jogger is jogging while the pace sound is being produced, and when the jogger desires to change the pace, the fifth and sixth switches S5 and S6 must be used to change the pace. In particular, if he wants to increase the pace, the fifth switch S5 must be depressed. On the other hand, if he wants to decrease the pace, the sixth switch S6 must be depressed. Upon depression of the fifth switch S5, the one-shot pulse is output from the one-shot circuit 75 and supplied to the AND circuit 76. While the pace sound is being produced, the output from the output terminal Q of the T flip-flop 46 is set to "1". This output is supplied to the AND circuits 76 and 78. The one-shot pulse output from the one-shot circuit 75 is thus output from the AND circuit 76 and supplied to the count-up signal input terminal of the pace selection counter 48 through the OR circuit 70. The count value of the pace selection counter 48 is incremented and the pace is increased. On the other hand, upon depression of the sixth switch S6, the one-shot pulse from the one-shot circuit 77 is output and supplied to the count-down signal input terminal of the pace selection counter 48 through the AND circuit 78. The count value of the pace selection counter 48 is decremented and the pace is decreased. In this manner, even if the jogger is jogging, with the fifth switch S5 or the sixth switch S6, the pace can be increased or decreased easily.

Figure 13:
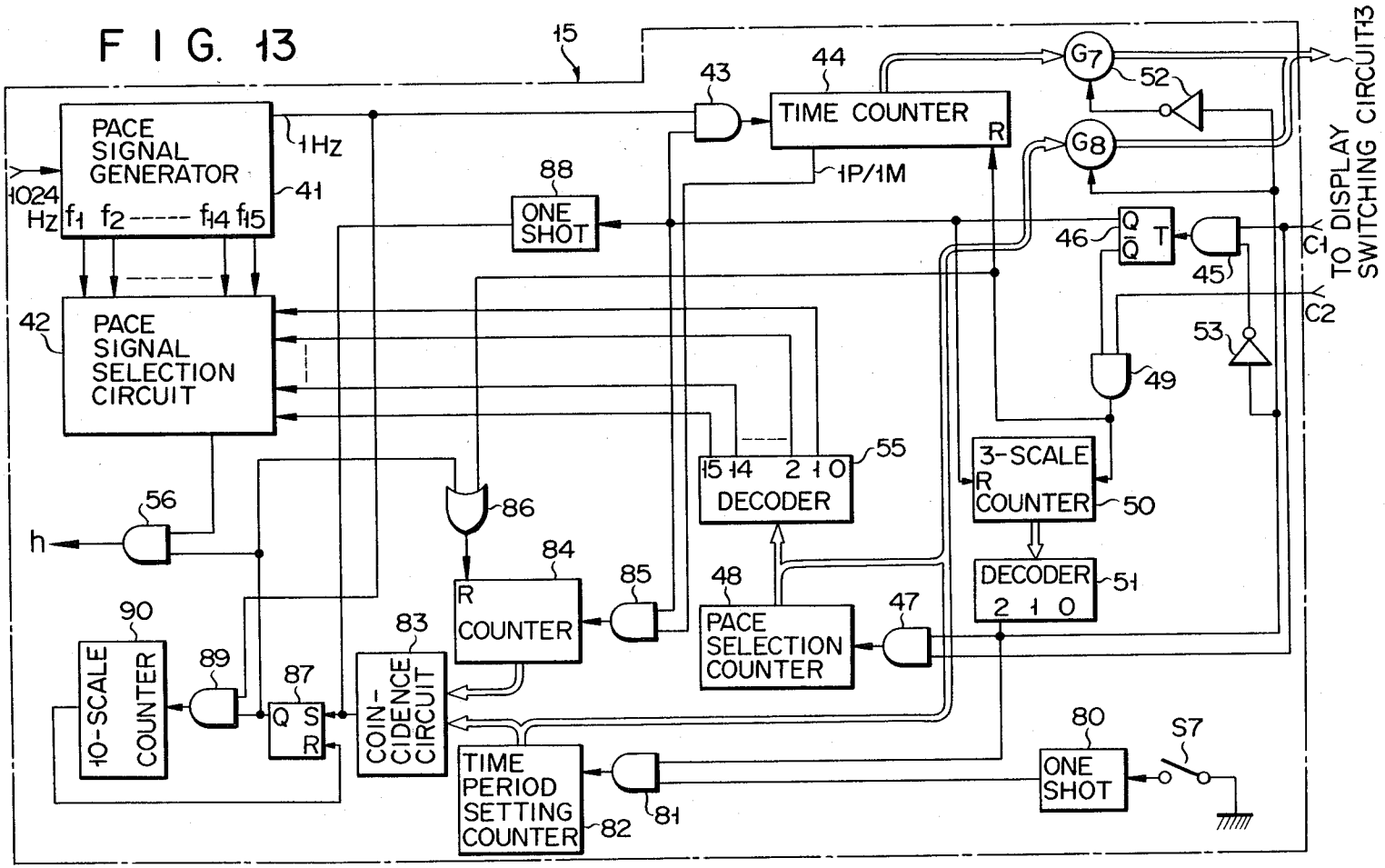
FIG. 13 is a block diagram of a pacemaker circuit 15 according to still another embodiment of the present invention.

A sound generating device for a jogger according to still another embodiment of the present invention will be described with reference to a pacemaker circuit of FIG. 13. In the third embodiment, the same reference numerals as in FIG. 5 denote the same parts in FIG. 13 and the detailed described thereof will be omitted. In this embodiment, the pace sound can be produced at a predetermined period. Further, at predetermined time intervals, a desired pace sound can be produced for a predetermined period of time, that is, a few seconds. Therefore, power consumption in the sound generating section is extremely reduced. In the pacemaker circuits 15 as shown in FIGS. 5 and 12, the P code generator is separately arranged. However, in the third embodiment as shown in FIG. 13, the pace selection counter 48 operates to generate the P code. The count value of the pace selection counter 48 is supplied together with the P code to the display switching circuit 13 through a gate circuit G8. Further, a seventh switch S7 for setting the period of the sound signal is output together with the one-shot pulse through a one-shot pulse circuit 80 and supplied together with the decoded output for "2" from the decoder 51 to a time period setting counter 82 through an AND circuit 81. The setting contents of the time period setting counter 82 are supplied to a coincidence circuit 83 and, at the same time, to the display switching circuit 13 through the gate circuit G8. An output from a counter 84 is supplied to the coincidence circuit 83. The count signal input terminal of the counter 84 receives the output from the output terminal Q of the T flip-flop 46 and a one-minute signal 1P/1M output from the time counter 44 through the AND circuit 85. The output from the AND circuit 49 is supplied to the reset terminal R of the counter 84. If the count values of the counters 82 and 84 coincide, the coincidence circuit 83 outputs a coincidence signal so as to set an RS flip-flop 87. The output from the output terminal Q of the T flip-flop 46 is supplied to the set terminal S of the RS flip-flop 87 through a one-shot circuit 88. The output from the RS flip-flop 87 is supplied, together with the signal of 1 Hz output from the clock pulse generator 41, to a 10-scale counter 90 through an AND circuit 89. The carry signal from the 10-scale counter 90 is supplied to the reset terminal R of the RS flip-flop 87. The output from the RS flip-flop 87 is supplied to the OR circuit 86 and the AND circuit 56.

The mode of operation of the pacemaker circuit 15 of FIG. 13 will be described. When the first switch S1 is depressed, the jogging mode is initiated and the pacemaker function is specified. Upon depression of the first switch S1, the count value of the mode switching counter 24 of FIG. 3 is incremented from "1" to "2". The decoded output for "2" from the decoder 25 is set to level "1". The dot display element A2 of the display part 3 is driven and the symbol "JOG" is displayed thereat. In response to the output from the decoder 25, the gate circuit G4 of the display switching circuit 13 is rendered conductive. The pace data D4 output from the pacemaker circuit 15 is selected and supplied to the display part 3. Further, the decoded output for "2" from the decoder 25 is supplied to the decoder 26. The decoder 26 selects the output lines for the signals c1 and c2. In the jogging mode, the pacemaker sound is produced and simultaneously the jogging time is counted. The third switch S3 serves as the start and stop switches. In particular, when the third switch S3 is depressed in the jogging mode, the one-shot pulse is output from the one-shot circuit 23 of FIG. 3. This pulse is decoded in the decoder 26 which outputs the signal c1. The signal c1 is supplied to the pacemaker circuit 15 of FIG. 13 and to the AND circuit 45. At this time, the decoded output for "2" from the decoder 51 is set to level "0". The output from the inverter 53 is set to "1" and supplied to the AND circuit 45. Therefore, the signal c1 is supplied to the T flip-flop 46 through the AND circuit 45. The T flip-flop 46 is thus inverted and outputs a signal of level "1" from the output terminal Q. The 3-scale counter 50 is then reset and the AND circuits 43 and 85 are rendered conductive. The signal of 1 Hz output from the clock pulse generator 41 is supplied to the time counter 44 through the AND circuit 43. The time counting operation for jogging is started. At this time, no decoded output for "2" from the decoder 51 is set. The output from the inverter 52 is set to "1" and the gate circuit G7 is in the on state. Therefore, time counting data output from the time counter 44 is supplied to the display switching circuit 13 through the gate circuit G7. The data is displayed at the display part 3, as shown in FIG. 8(*a*). Further, the count value of the pace selection counter 48 is set with the second and third switches S2 and S3 to be described later. In accordance with the setting value, the decoder 55 supplies the signal to the pace signal selection circuit 42. The pace signal selection circuit 42 selects one of the clock pulses f1 to f15 shown in Table 1 in response to the signal from the decoder 55 and supplies the selected pulse to the AND circuit 56. Further, when the output from the output terminal Q of the T flip-flop 46 is set to "1", a one-shot pulse is output from the one-shot circuit 88. The RS flip-flop 87 is set and supplies an output of level "1" from the output terminal Q. The AND circuits 56 and 89 are then rendered conductive. The pace signal selected in the pace signal selection circuit 42 is supplied to the sound control section 17 through the AND circuit 56. Thus, the pace sound is produced. When the AND circuit 89 is rendered conductive, the signal of 1 Hz output from the clock pulse generator 41 is supplied to the 10-scale counter 90 through the AND circuit 89. The 10-scale counter 90 thus starts counting. When the count value of the 10-scale counter 90 reaches 10, the 10-scale counter 90 generates the carry signal. The RS flip-flop 87 is thus reset. The output from the RS flip-flop 87 is set to "0". The AND circuit 56 is turned off and the operation for producing the pace sound is interrupted. Further, the AND circuit 89 is turned off and the counting operation of the 10-scale counter 90 is interrupted. Thus, with the third switch S3, when the time counter 44 starts counting, the pace sound is produced, for the first 10 seconds.

Furthermore, when the time counter 44 starts counting, it generates the one-minute signal 1P/1M and supplies it to the counter 84 through the AND circuit 85. The count value of the counter 84 is thus incremented. The count value of the counter 84 is supplied to the coincidence circuit 83 and is compared with the preset count value of the counter 82 for setting the period of the sound signal. If the count value is set to "20", that is, if the count value reaches 20 which corresponds to 20 minutes, the coincidence signal is output from the coincidence circuit 83. The flip-flop 87 is set again. The counter 84 is then reset. Simultaneously, the AND circuit 56 is rendered conductive for 10 seconds until the SR flip-flop 87 is reset in response to the output from the 10-scale counter 90. The pace signal selected by the pace signal selection circuit 42 is supplied to the sound control section 17 and the pace sound is produced. In the same manner as described above, the pace sound is produced for 10 seconds every 20 minutes. With the pace sound, the jogger can jog. However, if the jogger wants to interrupt or terminate jogging, the third switch S3 is depressed again. Upon depression of the third switch S3, the signal c1 is output from the switch control section 18 and supplied to the T flip-flop 46 through the AND circuit 45. The T flip-flop 46 is inverted, and produces the signal of level "0" from the output terminal Q. The AND circuits 43 and 85 are then turned off. The time counter 44 stops counting. The current time data is displayed at the display part 3, as shown in FIG. 8(*b*). When jogging is to be restarted, the third switch S3 is depressed. Upon depression of the third switch S3, the signal c1 is output from the switching control section 18 and supplied to the T flip-flop 46 through the AND circuit 45. The T flip-flop 46 is inverted and outputs the signal of level "1" from the output terminal Q. The AND circuits 43 and 85 are rendered conductive. The time counting operation by the timer counter 44 is started and the pace sound which has a predetermined period is produced again. On the other hand, in the non-counting operation, as shown in FIG. 8(*b*), when the count value is to be cleared or when jogging is to be terminated, the second switch S2 is depressed. Upon depression of the second switch S2, the signal c2 is output from the switching control section 18 and supplied to the AND circuit 49. At this time, the T flip-flop 46 outputs the signal of level "1" from the output terminal $\overline{Q}$. This signal is supplied to the AND circuit 49. Thus, the signal c2 is output through the AND circuit 49. The count value of the 3-scale counter 50 is incremented from "0" to "1". Simultaneously, the time counter 44 is cleared, as shown in FIG. 8(*c*). When the time counting operation is to be started again, in the above condition, the third switch S3 is depressed. The T flip-flop 46 is inverted so as to start the time counting operation and the generation of the pace sound. When the jogging pace is to be set, in the state in which the time counter 44 is cleared as shown in FIG. 8(*c*), the second switch S2 is depressed. Upon depression of the second switch S2, the signal c2 is output from the switch control section 18 and supplied to the 3-scale counter 50 through the AND circuit 49. The count value of the 3-scale counter 50 is output through the AND circuit 49. The count value of the 3-scale counter 50 is incremented from "1" to "2" and the decoded output for "2" from the decoder 51 is set to level "1". The gate circuit G8 is rendered conductive and the inverters 52 and 53 output the signals of level "0". The gate circuit G7 and the AND circuit 45 are turned off. When the gate circuit G8 is turned on, the P code output from the pace selection counter 48 and the count value thereof are supplied together with the count value of the time period setting counter 82 to the display switching circuit 13 through the gate circuit G8 and displayed as "P:$3_{20}$" at the display part 3, as shown in FIG. 8(*e*). Thereafter, when the third switch S3 is depressed, the signal c1 is output from the switching control section 18 and supplied to the pace selection counter 48 through the AND circuit 47. The count value of the pace selection counter 48 is incremented and displayed at the display part 3. The display contents can be checked while the third switch S3 is being depressed. The relationship between the paces symbols P0 to P15 and paces is shown in Table 1. Further, they are printed on the face 2 for convenience to the user. In the above state, when the seventh switch S7 for setting the period of the sound signal is depressed, the one-shot pulse is output from the one-shot circuit 80 and supplied to the time period setting counter 82 through the AND circuit 81. The count value of the counter 82 is incremented. The count value of the time period setting counter 82 together with the count value of the pace selection counter 48 are displayed at the display part 3. The jogger can check the display contents while depressing the seventh switch 7 so as to set the period of the sound signal. For example, "P:$3_{20}$" indicates the pace sound for pace 3 which is produced for a 20-minute period. After the pace and the sound period are set, upon depression of the second switch S2, the signal c2 is output from the switching control section 18. The count value of the 3-scale counter 50 is decremented to "0". The decoded output for "2" from the decoder 51 is set to level "1". The state as shown in FIG. 8(*c*) is restored. Thereafter, in accordance with the setting value of the pace selection counter 48, the pace signal is selected and the pace sound is produced in accordance with the period of the sound signal which corresponds to the count value of the time period setting counter 82. Thus, in the jogging mode, the pace sound is periodically produced and simultaneously the jogging time counting operation is performed.

In the above embodiment, the jogging pace is displayed as "P:$3_{20}$". However, the pace may be displayed by the number of steps in a certain period of time such as "130".

Further, in the above embodiment, the sound producing device for a jogger is applied to a wristwatch. However, the present invention is not limited to this application. For example, a pacemaker may be independently arranged. Further, the device may be mounted in a compact electronic calculator, a pendant or the like.

Further, in the above embodiment, the sound generating intervals may be arbitrarily selected. The number of sound generating durations may also be arbitrarily selected. For example, the pace sound may be generated for the first one minute. The same pace sound may be further generated after a certain interval.

What is claimed is:

1. A sound generating device for a jogger, comprising:

reference signal generating means (10, 11) for generating frequency-divided time counting reference signals;

switching means ($S_2$, $S_3$, 18) for selectively supplying start and stop instruction signals and select instruction signal in accordance with at least one switching operation;

time counting means (44) for controlling a start and stop of a counting operation of said time counting reference signals in accordance with the start and stop instruction signals from said switching means ($S_2$, $S_3$, 18) and for producing count time data;

means (3, 13) for displaying time data which is output from said time counting means (44);

pace signal generating means (41) for receiving said time counting reference signal and for generating a plurality of pace signals of a different cycle;

pace signal selecting means (42, 47, 48, 49, 50, 51, 55) for selecting a pace signal of a desired cycle from said plurality of pace signals produced from said pace signal generating means, by said select instruction signal, and for producing it as an output signal;

first pace signal supply controlling means (46, 56) connected to said pace signal selecting means for producing the selected pace signal as a desired signal in accordance with said start instruction signal;

sound generating means (17, 20) for receiving said desired pace signal from said first pace signal supply controlling means and for generating a pace sound; and a second pace signal supply controlling means (71, 72) connected to said pace signal selecting means for supplying said desired pace signal to said sound generating means when said pace signal selecting means is operated upon receipt of said select instruction signal.

2. A sound generating device according to claim 1, in which said first pace signal supply controlling means (46, 56) includes inverting means (46) connected to said switching means ($S_2$, $S_3$, 18) for effecting a switching operation between a first state in which a desired pace sound is generated upon receipt of said stop and start instruction signals and a second state in which a desired pace signal can be selected subsequent to stopping the generation of the pace sound and, at the same time, operating the pace signal selecting means.

3. A sound generating device according to claim 1, further including counting means (73, 74) adapted to operate said second pace signal supply controlling means (71, 72) such that when the pace signal is supplied from said second pace signal supply controlling means (71, 72) to said sound generating means (17, 20) the counting of the frequency-divided time counting reference signals is started and that when the counted value reaches a predetermined value a supply of the pace signal to said sound generating means (17, 20) is interrupted.

4. A sound generating device according to claim 1, further including pace code display controlling means (52, 54, G7, G8) for displaying, on said displaying means (3, 13), numerical data corresponding to the pace signal which is selected from said pace signal selecting means by said select instruction signal.

5. A sound generating device according to claim 1, further including another switching means ($S_5$, $S_6$, 75, 76, 77, 78) for operating said pace signal selecting means to permit said pace signal of said different cycle to be selected when said first pace signal supply controlling means (71, 72) supplies the selected pace signal to said sound generating means (17, 20).

* * * * *